US005466127A

United States Patent [19]

Arnswald

[11] Patent Number: 5,466,127

[45] Date of Patent: Nov. 14, 1995

[54] DEVICE FOR SWITCHING A SUBMERSIBLE MOTOR-DRIVEN PUMP ON AND OFF

[75] Inventor: Kurt W. Arnswald, Lohmar, Germany

[73] Assignee: WILO GmbH, Dortmund, Germany

[21] Appl. No.: 124,275

[22] Filed: Sep. 20, 1993

[30] Foreign Application Priority Data

Dec. 30, 1992 [DE] Germany ..... 42 44 417.9

[51] Int. Cl.[6] ..... F04B 49/00

[52] U.S. Cl. ..... 417/38; 73/753

[58] Field of Search ..... 417/38, 423.15, 417/423.3; 73/753, 754, 763, 781

[56] References Cited

U.S. PATENT DOCUMENTS

| | | | |
|---|---|---|---|
| 3,292,057 | 12/1966 | Touchy | 73/754 |
| 3,318,249 | 5/1967 | Loeser | 417/38 |
| 3,329,023 | 7/1967 | Kurtz et al. | 73/754 |
| 3,753,196 | 8/1973 | Kurtz et al. | 73/754 |
| 3,975,115 | 8/1976 | Fisher et al. | 417/38 |
| 3,992,130 | 11/1976 | Childress | 417/38 |
| 4,141,025 | 2/1979 | Bronshtein et al. | 357/26 |
| 4,484,862 | 11/1984 | Jensen | 417/36 |
| 4,587,840 | 5/1986 | Dobler et al. | 73/754 |
| 4,901,070 | 2/1990 | Vandevier | 340/856 |
| 4,992,030 | 2/1991 | Hasslen, III | 417/360 |

FOREIGN PATENT DOCUMENTS

| | | | |
|---|---|---|---|
| 0217231 | 8/1989 | Japan | 73/754 |
| 0163322 | 7/1991 | Japan | 73/754 |
| 405187944A | 7/1993 | Japan | 73/754 |

*Primary Examiner*—Richard A. Bertsch
*Assistant Examiner*—Xuan M. Thai
*Attorney, Agent, or Firm*—Herbert Dubno

[57] ABSTRACT

A device is provided for switching a submersible motor-driven pump on and off by a pressure sensor which measures the level of the liquid in the chamber enclosing the submersible motor-driven pump by the liquid pressure in the chamber, the pressure sensor being attached in or on the outside of the motor or pump casing and having a pressure-sensitive ohmic resistance.

7 Claims, 2 Drawing Sheets

DEVICE FOR SWITCHING A SUBMERSIBLE MOTOR-DRIVEN PUMP ON AND OFF

FIELD OF THE INVENTION

The invention relates to a submersible motor-driven pump which can be turned on and off by a pressure sensor which measures the level of the liquid in the chamber enclosing the submersible motor-driven pump by the liquid pressure in the chamber.

BACKGROUND OF THE INVENTION

Water levels are of course determined by means of floating switches, ultrasonics, electrodes or pressure monitors, the pump being switched on and off accordingly. However, the known devices each suffer from at least two of the following problems: nonadjustability, inaccuracy, expensive construction, high cost, technical complication, and significant unreliability.

The unreliability of floating switches is due to the fact that solids may become deposited thereon, electrodes may become dirty; in ultrasonics the echo may suffer interference from foam on the water surface. The mechanical apparatus of pressure monitors is vulnerable.

OBJECTS OF THE INVENTION

It is an object of the invention so to improve a device of the kind specified that it has high accuracy and is of small dimensions, while being highly insensitive to interference and simply constructed.

Another object of the invention is to provide an improved submersible pump with greater reliability of detecting a liquid level at the exterior of the pump and controlling the electric motor thereof with high sensitivity.

It is also an object of this invention to provide a low cost control system for a submersible pump which is more reliable than earlier systems and has a reliably simple construction, being free from pressure sensors with the drawbacks of earlier systems.

Another object of my invention is to provide an improved submersible pump free from drawbacks of prior art submersible pumps.

SUMMARY OF THE INVENTION

This problem is solved according to the invention by providing the pressure sensor in or on the outside of the motor or pump casing so that the pressure sensor has a pressure-sensitive ohmic resistance.

More particularly, the submersible pump of the invention can comprise:

- a pump housing having an intake and an outlet and means in the housing for displacing a liquid in which the pump is submerged from the intake to the outlet;
- an electric motor having a motor casing connected to the housing, the motor being operatively connected to the means in the housing for driving same;
- a pressure sensor on one of the casing and the housing and comprising a pressure-sensitive ohmic resistance; and
- circuitry connected between the motor and the sensor for controlling energization of the pump.

The sensor of the device is a pressure-sensitive resistance of a few square centimeters in overall size, which can be attached, for example, by gluing as a noninterference-prone constructional member to the outside of the casing. Since it is an ohmic resistance, the two outgoing electric wires require no jacketing, such as is customary in electronic elements for protection against electrical and magnetic interference.

The two conductors of the sensor extend into the inside of the motor casing and from thence via the motor cable to the switch-gear. The switchgear has two control knobs, by means of one of which the distance between the level of switching on and off can be changed, by means of the second knob a fixed distance between them raised or lowered can be The sensor is not prone to electric and magnetic interference from dirt or additives and foam in waste water and permits remote control change in level, and therefore the switching on and off of the pumps. With the use of the same sensor, the following switching levels customary in submersible motor-driven pumps can be detected and processed as a signal: the switching-on level, switching-off level and the alarm level.

If further levels are to be measured, they can also be detected via the measuring sensor, which is disposed on the outside of the pump. The overall costs are extremely low.

Particularly advantageously the resistance has a conductor network having two noncontacting conductors extending one beside the other at an equal distance bridged by a semiconductor polymer foil which reduces the resistance when pressure is applied in the normal direction.

A construction in the simple electric connection is achieved if the two cables of the resistance extend into the inside of the pump or motor casing and from thence extend via a cable, more particularly the motor connecting cable, to switch-gear or circuitry. At the same time, the switchgear should have two controllers, of which the first controller determines the level of switching on and off, while the second controller shifts the level of switching on and off by a constant distance, so that a particularly simple control can be achieved.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
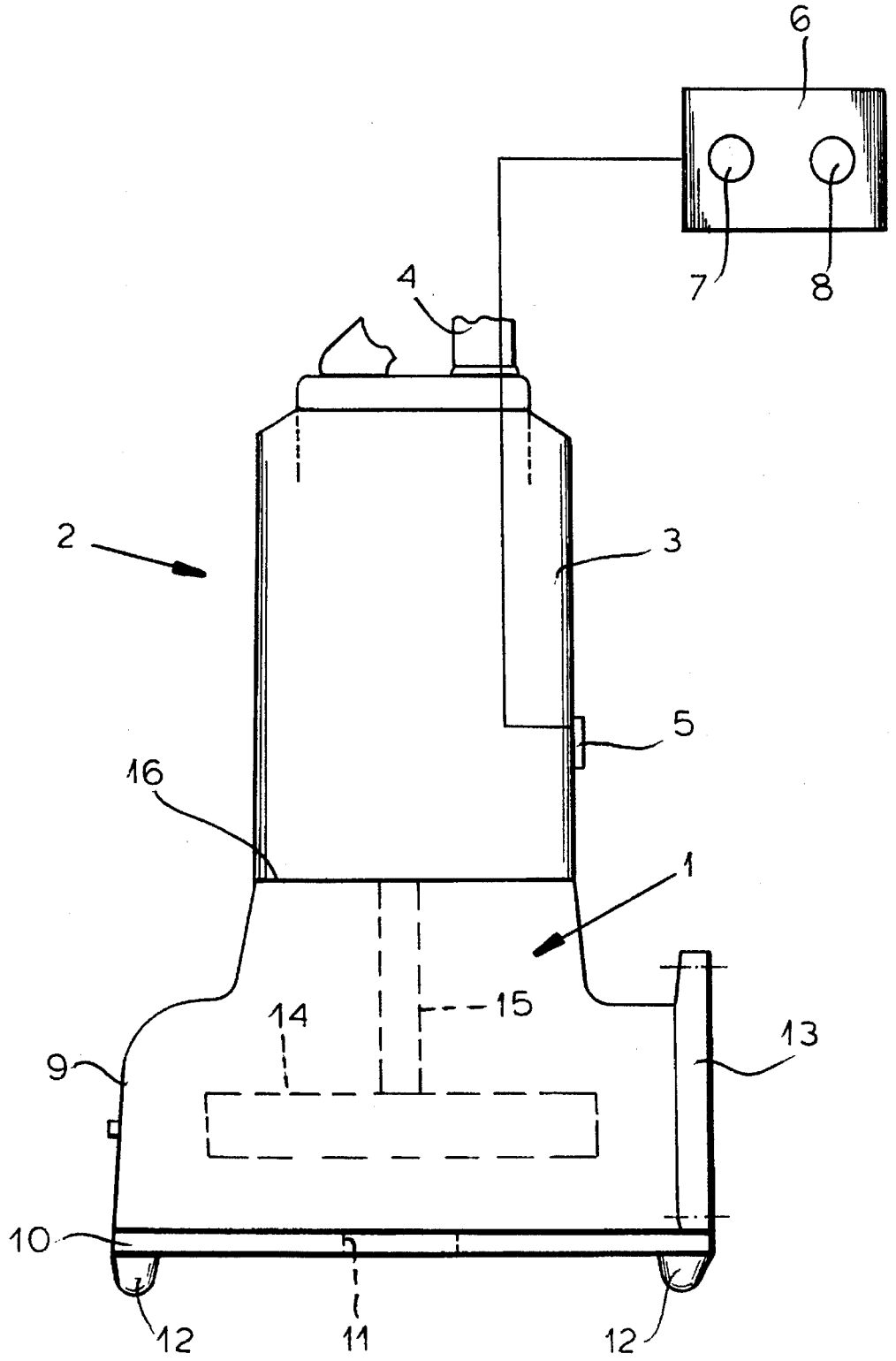
FIG. 1 is a side elevational view highly diagrammatically illustrating the principles of the invention.

A pump has a pump casing 1 forming a pump chamber in which a rotor rotates. The rotor is driven by an electric motor 2 whose casing 3 is attached to the pump casing. The casing 1 of the pump can be a two-part pump housing as described in German application P42 33 594.9 filed 6 Oct. 1992. As described in that application, a cup-shaped housing part 9 is closed at its open side by a wall-forming housing part 10 utilizing a band or ring, the wall-forming housing part providing an intake 11 for a pump which can stand on feet 12 above the bottom of a reservoir containing the liquid to be pumped. The discharge port or outlet 13 can be connected to a hose or pipe carrying the pump liquid away.

Diagrammatically represented within the pump casing, is an impeller or rotor 14 which is mounted on a shaft 15 of the motor 2 which has its housing 3 attached to the bottom 16 of the pump casing.

To enable the pump to be used as a submersible motor-driven pump, the casing and the interior are sealed against the entry of liquid, and more particularly cables 4 emerging at the top of the rotor are provided with seals.

The cables 4 can be attached to the motor casing 3 by a multiconductor sealing connector of the type described in the commonly-owned application Ser. No. 08/114,317, (now U.S. Pat. No. 5,362,258 issued 8 Nov. 1994 filed 30 Aug. 1993 by myself and Manfred Zelder (now U.S. Pat No. 5,362,258 issued 8 Nov. 1994 based upon German application P42 30 138.6 filed 9 Sep. 1992 and incorporated herein in its entirety by reference.

A pressure sensor 5 is attached, more particularly glued, to the outside of the motor casing 3. The two electric wires of the pressure sensor 5 extend into the interior of the motor casing 3 and from thence into the cable 4 and to externally disposed switch gear of circuitry 6 which has two control knobs 7, 8. The distance between the level of switching on and off can be changed via the control knob 7, while the distance between these two levels is displaced via the control knob 8. Instead of the control knobs, some other kind of adjustment, more particularly press buttons can be provided.

The pressure sensor 5 is a foil switch having two polymer films. A conductive pattern in the form of interengaging electrodes is applied to one of the two polymer films. A semiconductor polymer is applied to the conductive pattern. If pressure is applied to the sensor in the normal direction, the resistance decreases, in that the distance between the two conductors becomes more permeable to current.

The two conductor networks, which do not contact one another, can engage in one another comb-fashion, so that there is a relatively large spacing zone between the two conductors—i.e., the spacing zone is relatively long for a constant distance.

Figure 2:
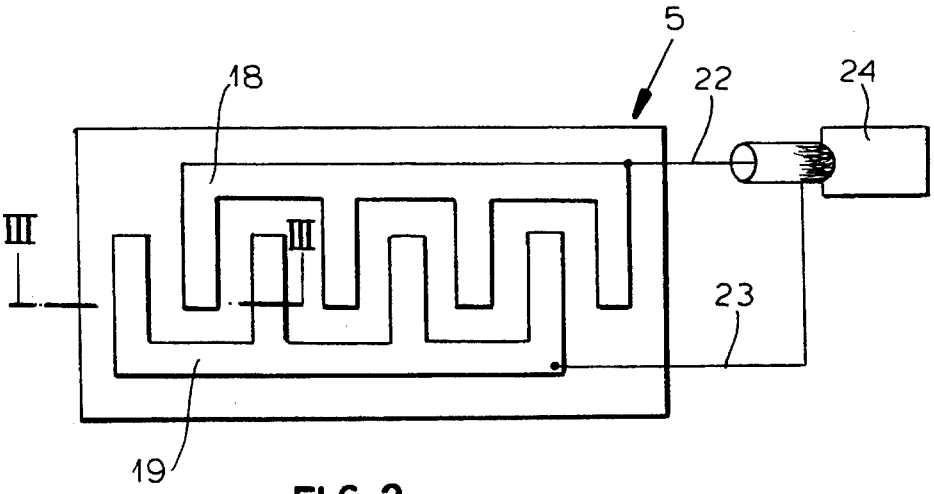
FIG. 2 is a diagrammatic view of a pressure sensor of the invention.
Figure 3:
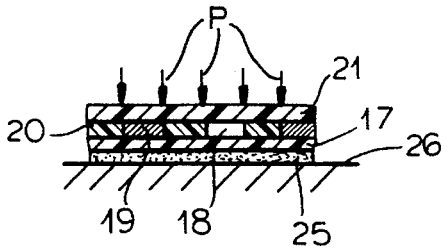
FIG. 3 is a cross sectional view taken along the line III—III of FIG. 2.

FIGS. 2 and 3, more particularly, I show a possible construction of the sensor 5. The sensor 5 can comprise a non-conductive foil substrate 17 on which the two conductors 18 and 19 are printed by any printed-circuit technique. The conductors 18 and 19 are of comb shape and interdigitate while forming a substantially constant distance between them which is substantial in overall length for high sensitivity. The conductors are separated by a semiconductor polymer 20 which fills the undulating space between and around the fingers of the conductors. A protective foil 21 covers the conductors and the semiconductor foil The sensor is sensitive to pressure in a direction normal to the sensor, i.e. perpendicular to the plane thereof as represented by the arrows P.

As pressure is applied in this direction, the conductivity of the semiconductive foil increases, decreasing the resistance as measured across the conductors. The leads 22 and 23 from these conductors can pass into a cable 24 which can extend in the manner previously described, into a connector for connection with the cable of the electric motor to the control circuitry 6.

As can also be seen from FIG. 3, the substrate foil 17 can be provided with an adhesive layer 25 for bonding the sensor to the external surface 26 of the motor casing 3 or the pump casing 1.

Figure 4:
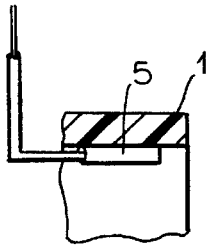
FIG. 4 is a cross sectional view illustrating the pressure sensor at the interior of the pump housing.

FIG. 4 shows that the sensor 5 can also be bonded on an internal surface of the pump casing 1, e.g. in the pumping chamber or at another location in the interior of the pump casing at which the pressure head of the liquid in which the pump is submerged, is effected to signal the level of the liquid in the reservoir from which the liquid is to be pumped.

Figure 5:
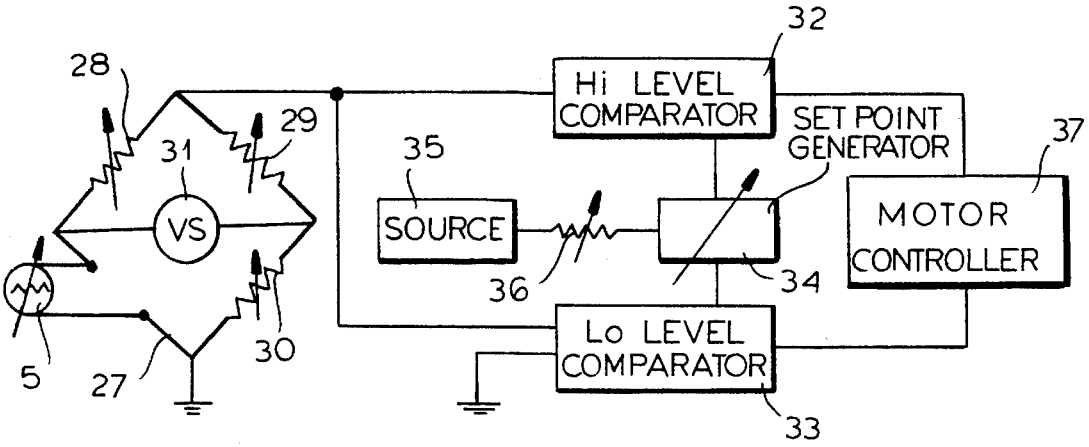
FIG. 5 is a diagram of circuitry which can be used to control the pump.

FIG. 5 shows highly diagrammatically a simple circuit for practicing the principles described. This circuit can comprise a wheatstone bridge 27 with resistances 28, 29 and 30 in a bridge circuit with the sensor 5 and supplied by a voltage source 31. The output of the bridge circuit can be applied to high-level and low-level comparators 32 and 33 supplied with the upper and lower thresholds of the pressure to which the pump is to be responsive as supplied by a setpoint generator 34. The latter can be supplied, in turn, by a voltage source 35 and a potentiometer 36 which may form the control 7 regulating the level of switching on and switching off. The setpoint generator 34 may be varied by the control 8 establishing the distance between the thresholds. The thresholds are applied to the motor controller 37 which turns on and off the motor 2.

I claim:

1. A submersible pump, comprising:

a pump housing member having an intake and an outlet and means in said housing member for displacing a liquid in which the pump is submerged from said intake to said outlet;

an electric motor having a motor casing member connected to said housing member, said motor being operatively connected to said means in said housing member for driving same;

a pressure sensor on one of said members and comprising a pressure-sensitive ohmic resistance; and circuitry connected between said motor and said sensor for controlling energization of said pump, said pressure-sensitive ohmic resistance having two uniformly spaced apart conductors bridged by a polymeric foil decreasing in ohmic resistance upon application of pressure normal to said foil.

2. The submersible pump defined in claim 1 wherein said ohmic resistance has two conductors extending into the interior of said casing member, said motor having a cable extending from said casing member and including said conductors, running to said circuitry.

3. The submersible pump defined in claim 2 wherein said circuitry has a first control for determining a liquid level at which said pump is switched on and off, and a second control for establishing a variable distance between switching on and off.

4. The submersible pump defined in claim 3 wherein said pressure sensor has a plastic foil on which said conductors are applied, said conductors having a comb shape.

5. The submersible pump defined in claim 3, further comprising an adhesive layer bonding said pressure sensor to an exterior of said casing member.

6. The submersible pump defined in claim 3, further comprising an adhesive layer bonding said pressure sensor to an exterior of said housing member.

7. The submersible pump defined in claim 3, further comprising an adhesive layer bonding said pressure sensor to an interior of said housing member.

* * * * *